United States Patent [19]

Roosen

[11] Patent Number: 4,604,811

[45] Date of Patent: Aug. 12, 1986

[54] HOLDING UNIT FOR MOUNTING AND ALIGNING PRINTING PLATES

[76] Inventor: Reiner Roosen, Von-Eiff-Strasse 23, D-6450 Hanau/Main 7, Fed. Rep. of Germany

[21] Appl. No.: 700,770

[22] PCT Filed: Mar. 29, 1984

[86] PCT No.: PCT/EP84/00089

§ 371 Date: Feb. 11, 1985

§ 102(e) Date: Feb. 11, 1985

[87] PCT Pub. No.: WO84/04900

PCT Pub. Date: Dec. 20, 1984

[30] Foreign Application Priority Data

Jun. 11, 1983 [DE] Fed. Rep. of Germany ... 8317151[U]

[51] Int. Cl.[4] ..... B41B 1/00

[52] U.S. Cl. ..... 33/184.5; 101/DIG. 12

[58] Field of Search ..... 101/DIG. 12, 378, 415.1; 33/184.5, 184.6

[56] References Cited

U.S. PATENT DOCUMENTS

| | | | |
|---|---|---|---|
| 2,559,533 | 7/1951 | Daniels | 101/DIG. 12 |
| 2,641,181 | 6/1953 | Leeberg | 101/DIG. 12 |
| 2,810,204 | 10/1957 | Imshaug | 33/184.5 |
| 2,902,771 | 9/1959 | Stickney | 33/184.5 |
| 3,206,859 | 9/1965 | Walsh | 33/184.5 |
| 3,550,283 | 12/1970 | Bernardi et al. | 101/378 X |
| 4,033,259 | 7/1977 | Schuhmann | 33/184.5 X |

FOREIGN PATENT DOCUMENTS

| | | | |
|---|---|---|---|
| 1611383 | 12/1970 | Fed. Rep. of Germany . | |
| 851841 | 10/1960 | United Kingdom | 101/DIG. 12 |

*Primary Examiner*—Clifford D. Crowder

*Attorney, Agent, or Firm*—Dennison, Meserole, Pollack & Scheiner

[57] ABSTRACT

A holding unit (70) for mounting and aligning printing plates on a printing cylinder (72) of a flexography machine enabling an accurate adjustment of various printing plates with respect to each other. The unit (70) comprises a rail (76) releasably applicable to the cylinder (72). The rail (76) is provided with protuberances (78) which interact with recesses provided in the printing plates. The unit (70) is simply and accurately positioned by centering structure (92) bearing on the printing roll shaft (102).

6 Claims, 5 Drawing Figures

HOLDING UNIT FOR MOUNTING AND ALIGNING PRINTING PLATES

Figure 1:
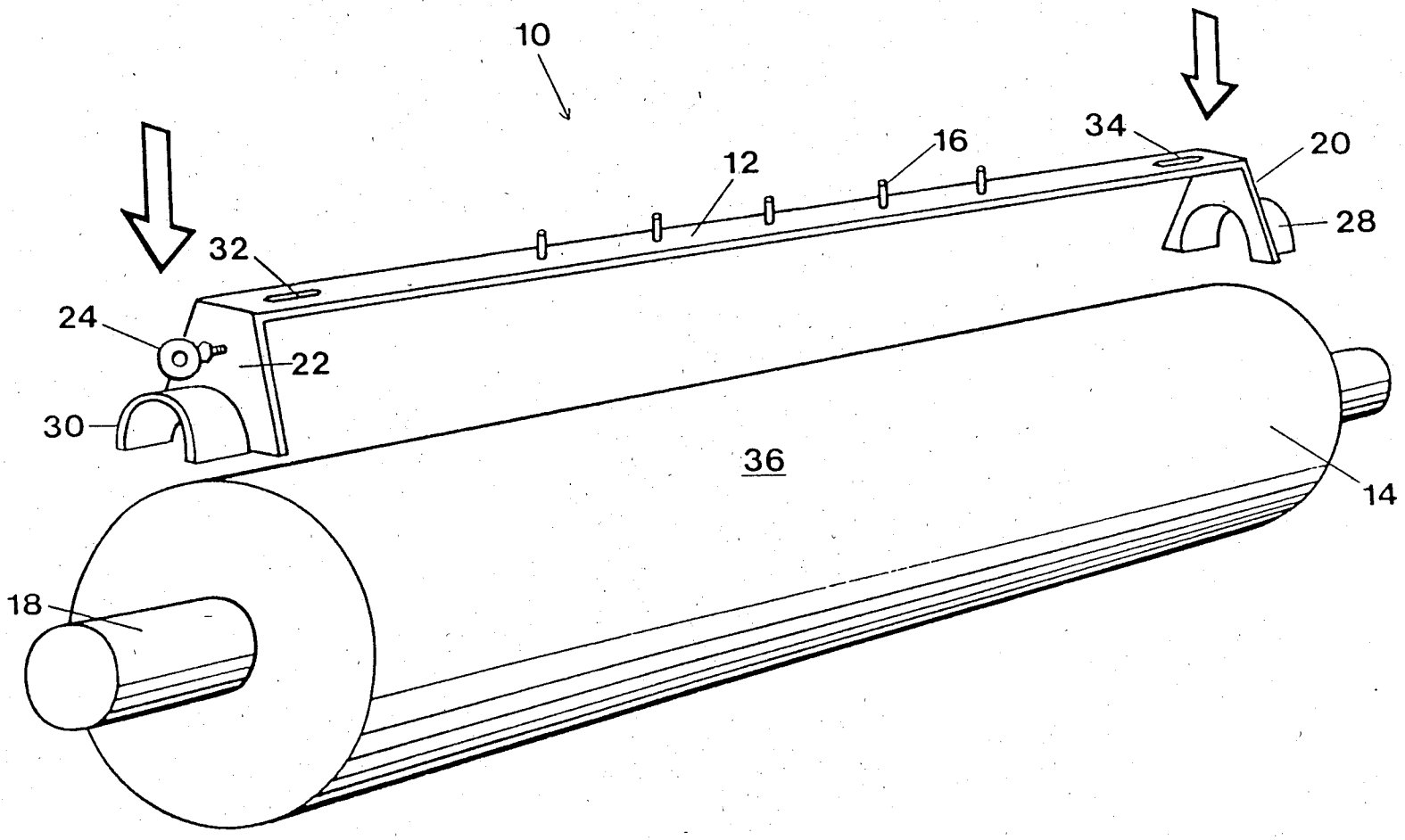

The invention relates to a fixture for printing plates to be mounted on impression cylinders of a Flexo-printing machine.

Flexo-printing is a high-pressure rotative process for e.g. the imprints on packing means, printed forms, prospectus or the like, where printing plates preferably composed of photo-polymers of rubber are glued onto the impression cylinders.

If one wants to print onto one and the same material in a simple manner letterings or e.g. pictures in different colors, then different plates are used which principally are applied on different impression cylinders in order to be able to carry out the printing work. However, that the coordination desired with respect to the printings relative to each other originating from the diverse plates can take effect, care must be taken that the plates will be arranged on the impression cylinders in an unmistakably coordinating position to each other. To this purpose one very often uses expensive paste-on machines, which enable the exact fitting coordination of one color to the other by means of mirror devices or any other optical apparatus. This kind of plate mounting is not only rather expensive but in addition presents considerable sources of error.

It is therefore the object of the present invention to make available a fixture for printing plates to be mounted on impression cylinders of a Flexo-printing machine, which makes it possible that different printing plates can be mounted in exact position on the impression cylinders of the Flexo-printing machine so that the finished printings will be perfect.

By the invention this object is realized in that the fixture comprises a rail or rib to be detachably mounted on the respective cylinder, which rib having projections or recesses intended for the accommodation of the printing plate. This fixture is mounted on the impression cylinder whenever a new cliché or, respectively a new printing plate shall be glued on the impression cylinder. Thereby always a clear orientation relative to the axis of the impression cylinder must take place. According to the invention this is guaranteed by the fixture. After this having been effected, the section getting in interaction with the rib is detached from said rib or rail in order to stick this area, too, onto the impression cylinder after the fixture itself has been removed. Accordingly the clichés, presenting a clear orientation with respect to each other in the machine, are applied to the other impression cylinders. Hereby it is guaranteed that the individual printing plates are arranged in exact fit to each other so that the finished printing work will not show any undesired overlappings caused by the individual plates. In order that the rib, which enables an extremely simple and exact fit of the arrangement of the printing plate on the respective impression cylinder, is running parallel to the longitudinal axis of the impression cylinder without any expensive adjusting measures, said rib or rail can be supported on the shaft of the cylinder and is at least partially enclosing said shaft. Hereby the rib is preferably of U-shaped configuration so that the angled-off legs extending at least partially along the faces of the impression cylinder, each having a recess adapted to the shaft. This can be e.g. the section of a hollow cylinder which is being mounted on the shaft. Of course, that section of the rib interacting with the shaft can also partially encircle the shaft from below in order to enable an even more safe arrangement of the fixture on the impression cylinder. According to an especially preferable embodiment of the invention those sections of the fixture extending along the faces of the cylinder are composed each of cheeks movable in the manner of scissors, having recesses facing each other of preferably V-shaped configuration, being interspersed by the pivot or, respectively the shaft of the cylinder, while at the same time an automatic centering is taking place. In addition, between the cheeks of each individual side section such a spring power is acting that said cheeks are always moved toward each other so that thereby the shaft of the cylinder can be clamped. Finally a swivelling fixing means can extend from one of the cheeks that can be positioned in a recess of the other cheek, in order to arrange the fixture irremovably on the shaft at an exact positioned orientation of the rib relative to the cylinder by means of the adjusting means, e.g. by the tightening of a nut. Thereafter the cliché can be mounted in exact position.

According to an especially preferred own-inventive embodiment the fixture is supported on the shaft or, respectively the cylinder pivot via centering means. Thereby each centering means is preferably of plate-shaped configuration, is running parallel to the faces of the cylinder and has an approximately V-shaped recess interacting sectionwise with the shaft or, resp. the pivot. Thereby the automatic centering is brought about. Since the centering means relative to the rail adjusting the printing plates on the impression cylinder and to the main axis of the cylinder are presenting a well defined coordination, it is thus guaranteed in a simple manner that the printing plates can be arranged on the impression cylinder is exact position.

In another embodiment the shaft in each time undergripped by a tension lever, via which a force in direction to the centering means can be generated. Thereby the fixture is clamped tightly on the shaft so that subsequently the printing plate can be arranged without any problems. The tension lever itself, which at the same time can be used as a handle for the total fixture, is in an initial position caused by a pressure spring and lifted from the shaft, and is being moved in direction of the shaft preferably via a turnbuckle against the spring power.

This movement in reality is a pivoting around a pivot going through the tension lever, starting from the fixture and of which the axis is extending parallelly to the longitudinal axis of the rib.

Finally, according to still another embodiment of the invention, the rib itself can be detachably arranged on the fixture and displaced toward the longitudinal axis of said fixture in order to thus increase the variability.

The rib itself can be adjusted in the cylinder axis by means of auxiliary devices or can have so-called orientation slits in its longitudinal direction, which must be adjusted to markings on the surface of the impression cylinder in order to guarantee in such a manner the exactly positioned arrangement of the fixture. Hereby it is ensured that the clichés to be mounted on the impression cylinders and aligned to the fixture will have the exact orientation relative to each other, so that the printing work when using different clichés being used one after the other for printing one and the same material, will show the desired quality. Of course, when there is existing only one impression cylinder, it is likewise possible by means of the fixture according to the invention to mount different printing plates one after the other in exact fit on said cylinder.

While the rib preferably has projections to which recesses are being coordinated in the margin area of the impression plate, there can, of course, any projections provided in the clichés be coordinated to recesses existing in the fixture. These projections, however, must be kept so small that they will not interfere with the printing process.

As an alternative, projections can be arranged detachably on the impression cylinders themselves, projecting from the cylinder surfaces for the alignment of the printing plates to be mounted one after the other. After the printing plates are fixed on the cylinders, thus are being glued on, the projections can be removed again. In this event this projections should preferably be shaped like pins and at least in one section thereof have an exterior thread, which can interact with a thread trimmed into the impression cylinder. It goes without saying that the impression cylinder can have recesses for the exactly positioned alignment of clichés, into which recesses then the projections on the printing plates can be inserted.

Figure 2:
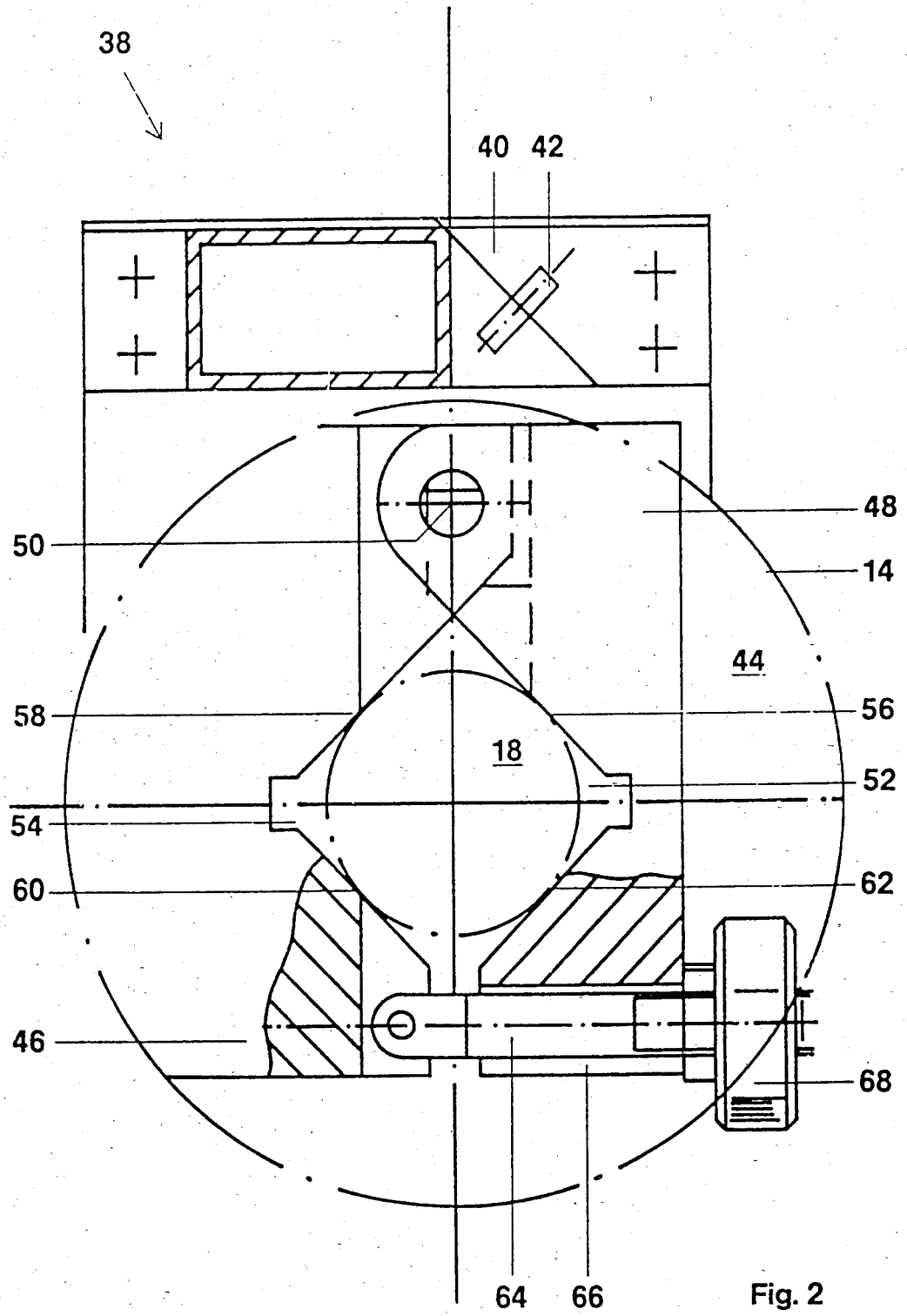
Figure 3:
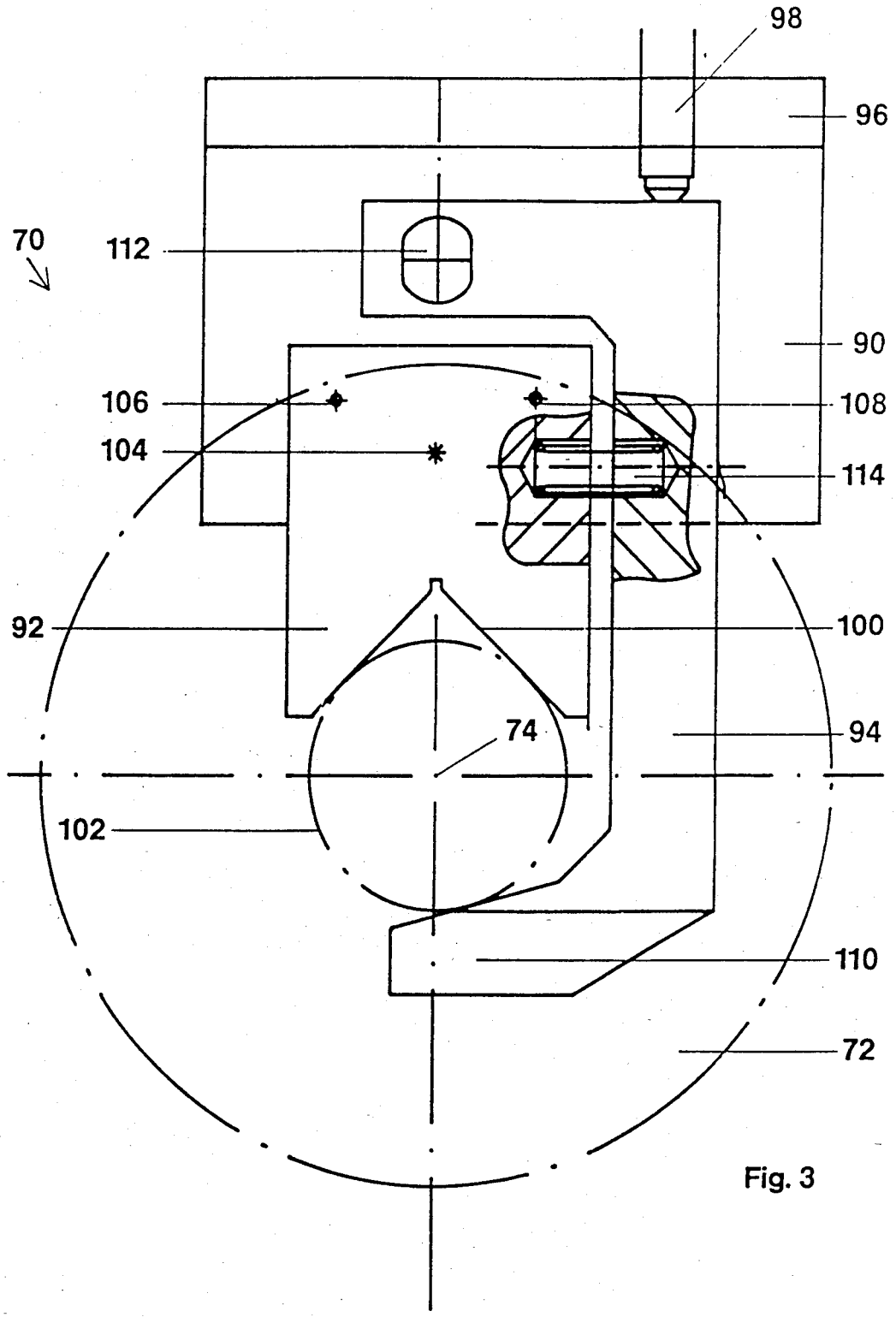
Figure 4:
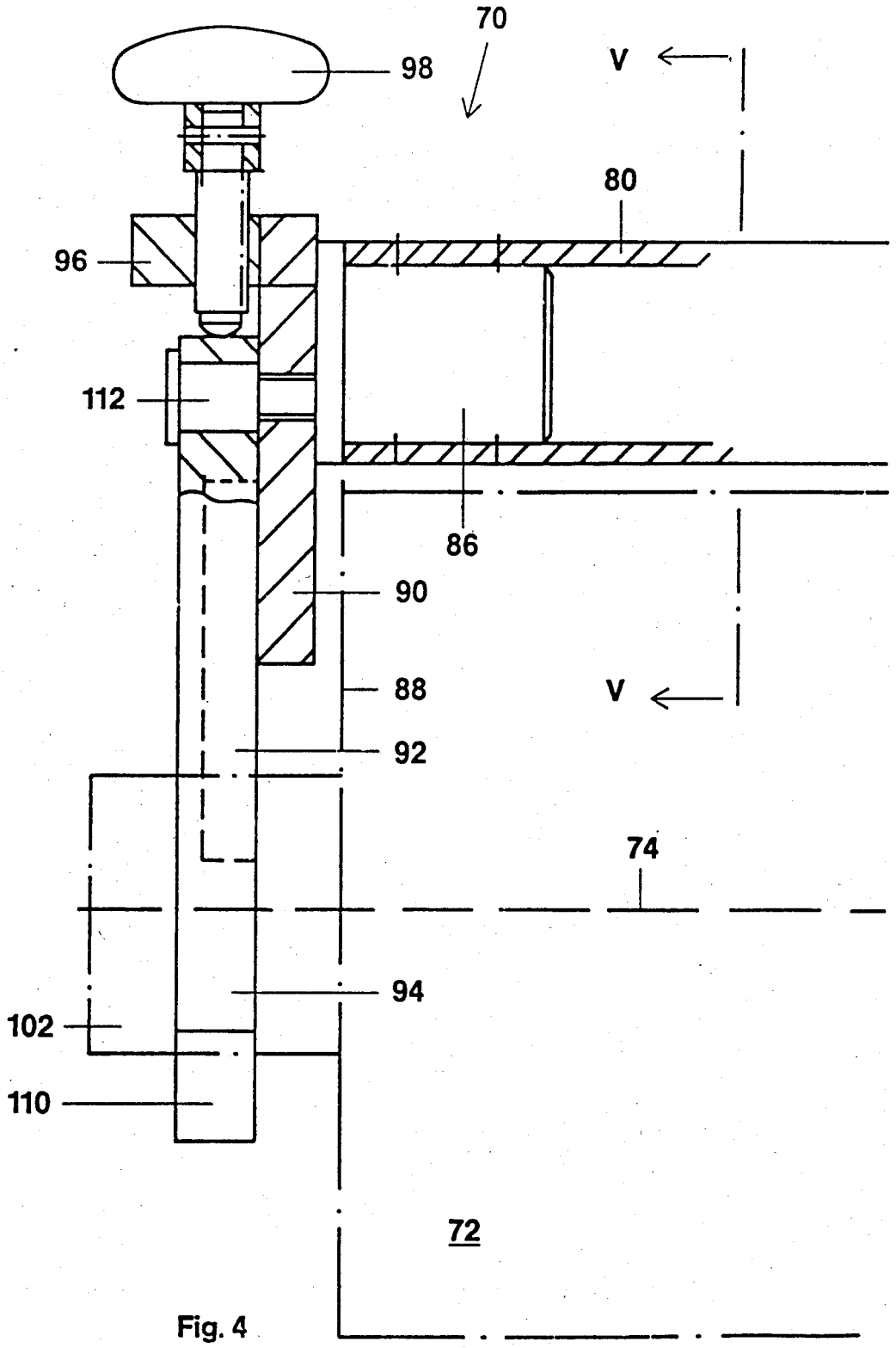
Figure 5:
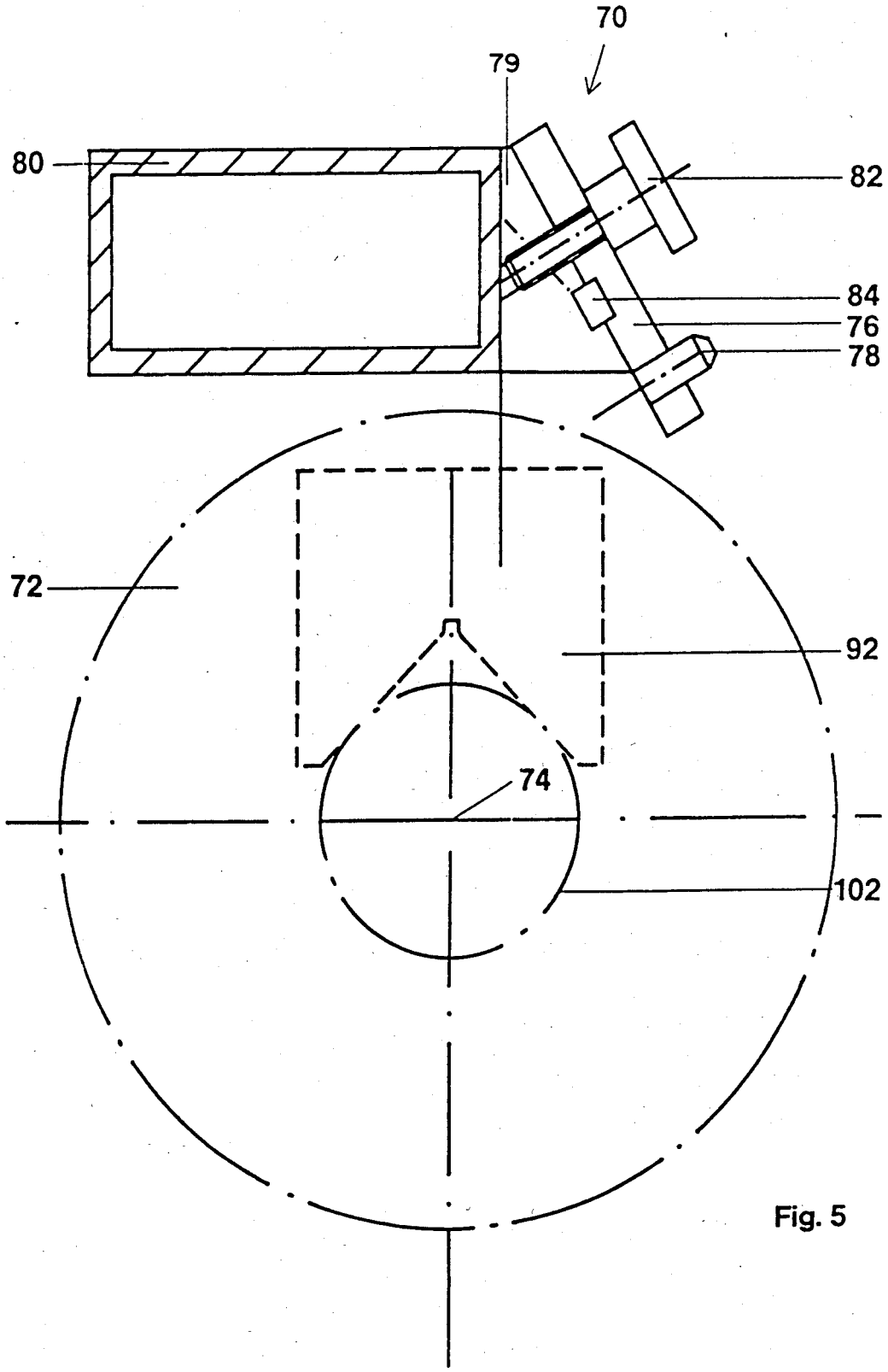

Further details, advantages and characteristics of the invention will follow not only from the claims but also from the preferred examples of embodiment as shown in the drawing, where FIG. 1 shows a fixture to be mounted on an impression cylinder, FIG. 2 is another embodiment example of a fixture to be arranged on an impression cylinder in side view and partially exploded, FIG. 3 is the side view of a third embodiment, FIG. 4 is a front view of a section of the embodiment according to FIG. 3, and FIG. 5 is a sectional view along the line V—V in FIG. 4.

As an example, FIG. 1 shows an impression cylinder 14 of a Flexo-printing machine with a removable fixture 10, being designed for the alignment of printing plates to be arranged on the impresion cylinder 14. Thereby the fixture 10 has preferably the shape of a rail or rib 12, having laterally angled-off end sections 20 and 22, which on their part are interacting with the shaft 18 of the impression cylinder 14. In the embodiment example of FIG. 1 the sections 20 and 22 have hollow cylinder-shaped sections 28 and 30, of which the inner diameter is adapted to the outer diameter of the shaft 18. Consequently, if the sections 28 and 30 are placed on the shaft 18, then the rib 12 is aligned to the longitudinal direction of the axis of the impression cylinder 14. Likewise the sections 20 and 22 of the rib 12 can be of another shape, e.g. they can have a section enclosing the shaft 18 from below.

The sections 20 and 22 are running parallel or almost parallel to the faces 36 of the impression cylinder 14 and can be undistortionably positioned on said cylinder by means of a fixing device like e.g. a screw 24. In order that the rail can be placed in a desired position without any expensive adjusting work not only parallel to the longitudinal axis of the cylinder 14 but also relative to the circumferential surface, longitudinal slits 32 or, resp. 34 are provided, extending in longitudinal direction of the rib 12, thus parallel to the longitudinal axis of the cylinder 14. Now the surface of the impression cylinder 14 has marking lines (not shown) to which the slits 32 and 34 are aligned. Subsequently the fixture 10 is taking the desired position relative to the cylinder 14, so that printing plates or, resp. clichés (not shown) can be placed thereon, which are then arranged in exact fitting on the impression cylinder 14 and relative to any further impression cylinders. To this effect, the rib 12 in this embodiment example has projections 16, coordinated to which being respective recesses on an edge of the printing plate. Now in order to mount a printing plate on the cylinder 14, the recesses of same are interspersed by the projections 16. Thereby the cliché receives the exactly fitting alignment relative to the impression cyliner 14. Thereafter that section of the printing plate being outside of the rib can be glued onto the printing plate without any difficulties. Subsequently that section of the cliché interacting with the rib 12 is lifted off said rib in order to be able to remove the fixture 10.

Finally the respective section of the printing plate is also pressed onto the printing plate 14 and glued on. If now a material to be printed shall be printed by means of a second cliché, then the fixture 10—as described above—is mounted on additional impression cylinders of the Flexo-printing machine being exactly oriented toward the impression cylinders 14, in order to cause the projections 16 to interact with the recesses of another clichés, whereby it is guaranteed that the additional clichés to be used do likewise have the exact-fit arrangement on the impression cylinders, which is necessary that the finished printing work does not show any undesired overlappings from the individual printing plates. Then the printing plates mounted by means of the fixture according to the invention will print in exact fit.

FIG. 2 shows the side view of the fixture 38, being arranged on the shaft 18 of the impression cylinder 14 in exact position, but can also be detached. The fixture 38 likewise comprises a rib 40 with projections 42, which can engage the recesses of the cliché (not shown). Along the faces (shown the face 44 of the cylinder 14) are running cheeks or member 46 and 48 that can shear apart and which together are defining sections corresponding to the action according to the elements 20, 22, 24, 28, 30 of the embodiment example after FIG. 1. The cheeks 46 and 48, that can pivot around the axis 50, are provided with V-shaped recesses 52 and 54 in the areas facing each other, which when put together are defining a square shape, and which with their terminating plates 56, 58, 60 and 62 while the fixture 38 is mounted on the cylinder 14, will section for section be resting on the core or the shaft 18. Thus an automatic centering will take place, all the more that the cheeks 46 and 48 due to spring power are attempting to keep the open space defined by the recesses 52 and 54 as small as possible. In addition, from the lower region of the cheek 46 a fixing means 64 is extending, being displaceable and which can be inserted in a recess 66 of the cheek 48 in such a manner that after an alignment in exact position of the fixture 38 on the cylinder 14 by means of the marginal sections 68 or a similarly acting means, the cheeks 46 and 48 are tightened in order to rest on the shaft 18 in undistortable position. Hereby it is guaranteed that the fixture 38 cannot be uncontrollably distorted.

FIGS. 3 to 5 show still another embodiment of a fixture 70 according to the invention, which fixture shall be aligned to an impression cylinder 72 of a Flexo-printing machine in exact position relative to the longitudinal axis 74 of the cylinder 72. Thereby the fixture comprises a small rail 76 having projections 78, on which clichés shall be arranged in the manner as described above. The rail 76 is movably arranged on a key 79, which on its part is preferably extending from a square tube 80 as a support. The sliding ability of the rail 76 is effected via a sliding block 84; which on the one side is inserted in the key 79 and on the other one is housed in the backside of the rail 76. The fixing of the rail 76 relative to the connecting tube 80 is done preferably by means of the knurl screw 82. The sliding ability of the rail 76 relative to the supporting tube 80 offers the advantage that the rail 76 and thus the cliché can be displaced horizontally to the impression cylinder 72.

From the supporting tube 80 via the pivot 86 (only the left pivot is shown) a connecting plate 90 each is extending on both sides of the faces 88 of the impression cylinder 72, on said connecting plates being fixed a centering member or means 92 as well as a tension lever 94. Further the connecting plate 90 in its upper region has a ledge 96, extending parallel or approximately parallel to the square tube 80 and angled-off from the connecting plate 90, which ledge being pierced by a fixing screw 98 for interacting with the tension lever 94.

Now the centering means 92 has a preferably V-shaped recess 100, that can be placed on the pivot or, resp. the shaft 102 of the impression cylinder 72. In the manner an automatic centering takes place. In order that the exact alignment of the rail 76 and thus that of the cliché takes place relative to the impression cylinder 72, the centering means 92 is adjustable via an adjusting screw 104 relative to the connecting plate 90, in order to be able to use aligning pins whenever the alignment true to position relative to the longitudinal axis 74 of the impression cylinder 72 is achieved (indicated by reference numbers 106, 108).

As soon as the fixture 70 is supported on the pivot 102 by means of the centering means 92, extending on both sides of the faces 88 of the impression cylinder 72, the pivot 102 is undergripped by the tension member or lever 94 whereby the immovability of the fixture 70 on the pivot 102 is guaranteed. To this effect the tension lever 94 by means of the fixing screw 98 is moved in direction to the pivot, in order to interact with a lower leg 110 on the bottom side or a cut into the bottom side of the shaft 102. Thereby the tension lever 94 can be turned around a pivot 112 and must be moved against a spring power being exercised by a pressure spring 114 in direction to the pivot 102 by means of the fixing screw 98; for in its normal position the tension lever 94 is swung off the pivot 102 so that said pivot can be used at the same time as a handle for the fixture 70.

Now by means of the fixture 70 according to the invention, clichés can be placed on the circumference of the impression cylinder 72 in exact position on the rail 76 or, resp. the projections 78, where then elements of the fixture 70 must be exchanged if the perimeter, diameter of pivot, or length of the impression cylinder 72 should change. If the perimeter and the pivot 102 of the impression cylinder 72 remain unchanged at a changed length, then only the connecting tube 80 must be exchanged without necessitating any changes with respect to the connecting plates 90 via the pivots 86, and the centering means 92 or, resp. the tension levers 94 extending from said plates.

However, if the diameter of the cylinder pivot 102 is being changed without varying the circumference and the length of the impression cylinder 72, then only the centering plates 92 must be exchanged. Otherwise the other means can be kept in order to guarantee an alignment in exact position of the fixture 70 relative to the longitudinal axis 74 of the impression cylinder 72. If only the circumference of the impression cylinder is changed while its length and the cylinder pivot remain the same, then the centering means as well as the tension levers must be exchanged in order to enable an alignment exact to position of the fixture 70.

For this purpose the fixture according to the invention can be completed from the very beginning with an assortment of centering means, tension levers or, resp. supporting tubes designed for different cylinder dimensions, in order to be able to use the fixture according to the invention in connection with diverse types of cylinders.

Of course the centering means 92 can be inserted in the connecting plates 90 to be vertically slidable in order to thus enable an adaption to different circumferences of cylinders and/or diameters of pivots. In these cases then one must only eventually exchange the tension levers.

While in the embodiment examples the easy alignment of clichés to be mounted on impression cylinders 14, 72 by means of the fixtures 10, 38, 70 has been described, as an alternative it is possible to arrange projections like e.g. pins detachably on the surface of the impression cylinder, which pins will likewise interact with recesses provided on printing plates. As soon as the printing plate is glued to the surface of the impression cylinder, the pins can be removed. Consequently the same advantages will result with respect to the alignment as those described in connection with the fixtures 10, 38, 70, even if thereby a damage to the surface of the cylinder must be put up with.

I claim:

1. A holding unit for mounting and aligning printing plates on the printing cylinder of a printing machine, said cylinder having a longitudinal axis, opposed end faces and a coaxial shaft with opposed coaxial shaft end portions projecting beyond the end faces; said holding unit comprising a straight rail adapted to parallel said cylinder in overlying relation thereto, said rail having opposed end portions, a pair of end sections engaged with said opposed end portions of said rail and extending generally laterally therefrom for overlying said end faces, said end sections each including a shaft-engaging structure configured to receive the corresponding shaft end portion, to self-center on the corresponding shaft end portion upon the shaft end portion being fully received therein, thereby positioning the rail of the holding unit parallel to the longitudinal axis of the cylinder, said rail including releasable plate securing means therealong for selective retention of printing plates on said rail for alignment on a cylinder, said releasable plate securing means being adapted to cooperate with complementary means on the plates to be mounted, said plate securing means and said complementary means comprising interengaging projections and recesses, said shaft-engaging structure of each end section comprising a pair of opposed members positionable to opposite sides of the corresponding shaft end portion, at least one of said members being mounted for movement, relative to the other member, toward and away from the corresponding shaft end portion for engagement and enclosure of the corresponding shaft end portion therebetween.

2. The holding unit of claim 1 wherein said members comprise a pair of cheeks mounted for movement relative to each other and including a pair of facing V-shaped recesses for reception of the corresponding shaft end portion therein upon movement of said cheeks toward said corresponding shaft end portion.

3. The holding unit of claim 2 including spring means biasing said cheeks toward each other, and lock means for releasably locking said cheeks upon engagement thereof with the corresponding shaft end portion.

4. The holding unit of claim 3 wherein said V-shaped recesses, when receiving the corresponding shaft end portion, defining a generally square configuration.

5. The holding unit of claim 1 wherein the pair of members of said shaft-engaging structure includes a centering member defining a generally V-shaped recess downwardly directed for engagement over the corresponding shaft end portion, and an upwardly directed component underlying the corresponding shaft end portion, and means exerting an upward force on said underlying component for movement of said underlying component to a shaft end engaging position for cooperation with the corresponding recess in engaging and centering the corresponding shaft end portion.

6. The holding unit of claim 5 wherein said underlying component comprises a pivoted lever, spring means biasing said lever away from the shaft end engaging position, and means for moving said lever against the biasing force of said spring means and into shaft engaging position.

* * * * *